US007997787B2

(12) United States Patent
Blair

(10) Patent No.: US 7,997,787 B2
(45) **Date of Patent: *Aug. 16, 2011**

(54) APPARATUS AND METHOD FOR USING RECIPROCATING HAND-HELD POWER TOOL FOR MIXING PAINT

(76) Inventor: Clifford E. Blair, Victor, ID (US)

( * ) Notice: Subject to any disclaimer, the term of this patent is extended or adjusted under 35 U.S.C. 154(b) by 827 days.

This patent is subject to a terminal disclaimer.

(21) Appl. No.: 11/934,749

(22) Filed: Dec. 19, 2007

(65) Prior Publication Data

US 2009/0161479 A1 Jun. 25, 2009

(51) Int. Cl.
*B01F 11/00* (2006.01)

(52) U.S. Cl. ..... 366/110; 366/130; 366/212

(58) Field of Classification Search ..... 366/108–114, 366/129–130, 208–219
See application file for complete search history.

(56) References Cited

U.S. PATENT DOCUMENTS

| | | | | | |
|---|---|---|---|---|---|
| 2,846,201 | A * | 8/1958 | Mermelstein | 366/110 |
| 3,330,537 | A * | 7/1967 | Wason | 366/114 |
| 4,318,622 | A * | 3/1982 | Sterrenberg | 366/110 |
| 4,398,829 | A * | 8/1983 | Shick | 366/110 |
| 4,420,262 | A * | 12/1983 | Sterrenberg | 366/110 |
| 5,098,193 | A * | 3/1992 | Christensen et al. | 366/130 |
| 5,273,357 | A * | 12/1993 | Currie | 366/110 |
| 5,439,287 | A * | 8/1995 | Roepke, Sr. | 366/130 |
| 5,451,105 | A * | 9/1995 | Koering | 366/130 |
| 5,897,205 | A * | 4/1999 | Sinsteden | 366/212 |
| 6,213,631 | B1 * | 4/2001 | Miranda | 366/130 |
| D609,990 | S * | 2/2010 | Blair | D8/71 |
| 2009/0161479 | A1 * | 6/2009 | Blair | 366/130 |

* cited by examiner

*Primary Examiner* — Charles E Cooley
(74) *Attorney, Agent, or Firm* — John C. Meline

(57) ABSTRACT

An apparatus and method for shaking a can of paint or bottle of aerosol spray paint. The apparatus comprises a cradle securely fastened to a tang and at least one strap for securing a can or bottle into the cradle. One end of the tang is shaped so as to be received in a chuck of a hand-held power tool such as a variable speed reciprocating saw. The apparatus is useful for quickly and effectively mixing relatively small cans of paint near in time and place to using the paint.

10 Claims, 3 Drawing Sheets

APPARATUS AND METHOD FOR USING RECIPROCATING HAND-HELD POWER TOOL FOR MIXING PAINT

BACKGROUND

1. Technical Field

The invention relates to a method and apparatus for shaking paint cans and other containers for the purpose of mixing their contents, and more particularly to an apparatus and method for mixing by reciprocating or cyclical motion generated by a hand-held power tool.

2. Description of Related Art

As is well known in the art, paint must be thoroughly mixed prior to use in order to ensure that components which separate over time are sufficiently mixed with each other prior to the paint's application on a surface. There are several known variants of a reciprocating paint shaker used for shaking relatively large containers of paint. Retail sales outlets typically have such shakers and provide a service of mixing paints and similar liquids for retail purchasers of paint. Such shakers are often unavailable for retail sale and it is inconvenient for painters to transport such shakers from place to place. Complicating this situation, a can of paint typically sets idle for an indeterminate time between the time it is mixed or shaken at a retail establishment and the time when it is applied.

Further, known shakers are typically not used in conjunction with relatively small sized liquid paint containers such as one-quart or one-liter sized containers. For containers of this type, a user is expected to shake the container manually or to stir its contents prior to use. Further, manual mixing or stirring often results in incomplete mixing of separated components particularly when a paint container has set idle for a long period of time. These containers typically must be mixed or stirred manually for a relatively long period of time to achieve proper mixing.

Similarly, aerosol spray paint containers typically require agitation immediately prior to use in order to prevent their contents from separating and allowing agglomerated pigment particles to clog the spray nozzle. Shaking machines typically are not used to agitate aerosol spray paint containers. Unless a user is sufficiently patient and intent on mixing such spray containers, there is a risk of insufficiently mixing the spray paint prior to use.

Accordingly, a need exists for an apparatus and a method for quickly and thoroughly shaking relatively small liquid paint containers and aerosol spray paint containers to ensure proper mixing of separated components. Painters using such small containers need a fast, efficient and safe apparatus and method for performing such mixing. Painters need an apparatus and method which can be used near the place and time of paint application.

There have been attempts at providing a solution to the problem outlined. For example, U.S. Pat. No. 4,318,622 describes an apparatus for shaking paint containers which is clamped to the vibrating sanding plate of a hand-held electric sander or secured to an electric hand-held drill. While patent '622 discloses the use of a hand-held power tool to mix paint, it discloses complex components and operation. The various methods and embodiments described in patent '622 suffer from a variety of drawbacks including complex assembly and operation.

None of the known inventions, patents and systems, taken either singularly or in combination, as found in the prior art describes the instant invention as claimed. Thus, there remains a need for a simple and safe method and apparatus for quickly and forcefully mixing relatively small cans of liquid and aerosol paint cans.

SUMMARY OF THE INVENTION

The present invention relates to an apparatus and method to mix paint or other materials with a hand-held power tool. In one embodiment, a cradle is securely attached to one end of a tang. A can or container is removably and securely fastened into the cradle by straps or other mechanism. The other end of the tang is formed into a standard shape and size to fit into a chuck of a hand-held power tool such as a reciprocating saw. The can of paint is quickly and forcefully mixed by operating the saw.

These and other features of the present invention will become readily apparent upon further review of the following specification and drawings.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

Throughout the drawings, where the same part appears in more than one drawing, the same number is applied thereto.

DETAILED DESCRIPTION

While the invention is described below with respect to one or more preferred embodiments, other embodiments are possible. The concepts disclosed herein apply equally to all varieties of apparatuses and methods for mixing the contents of relatively small cans. Nothing should be construed as limiting the inventive concept to any particular configuration or embodiment.

Figure 1:
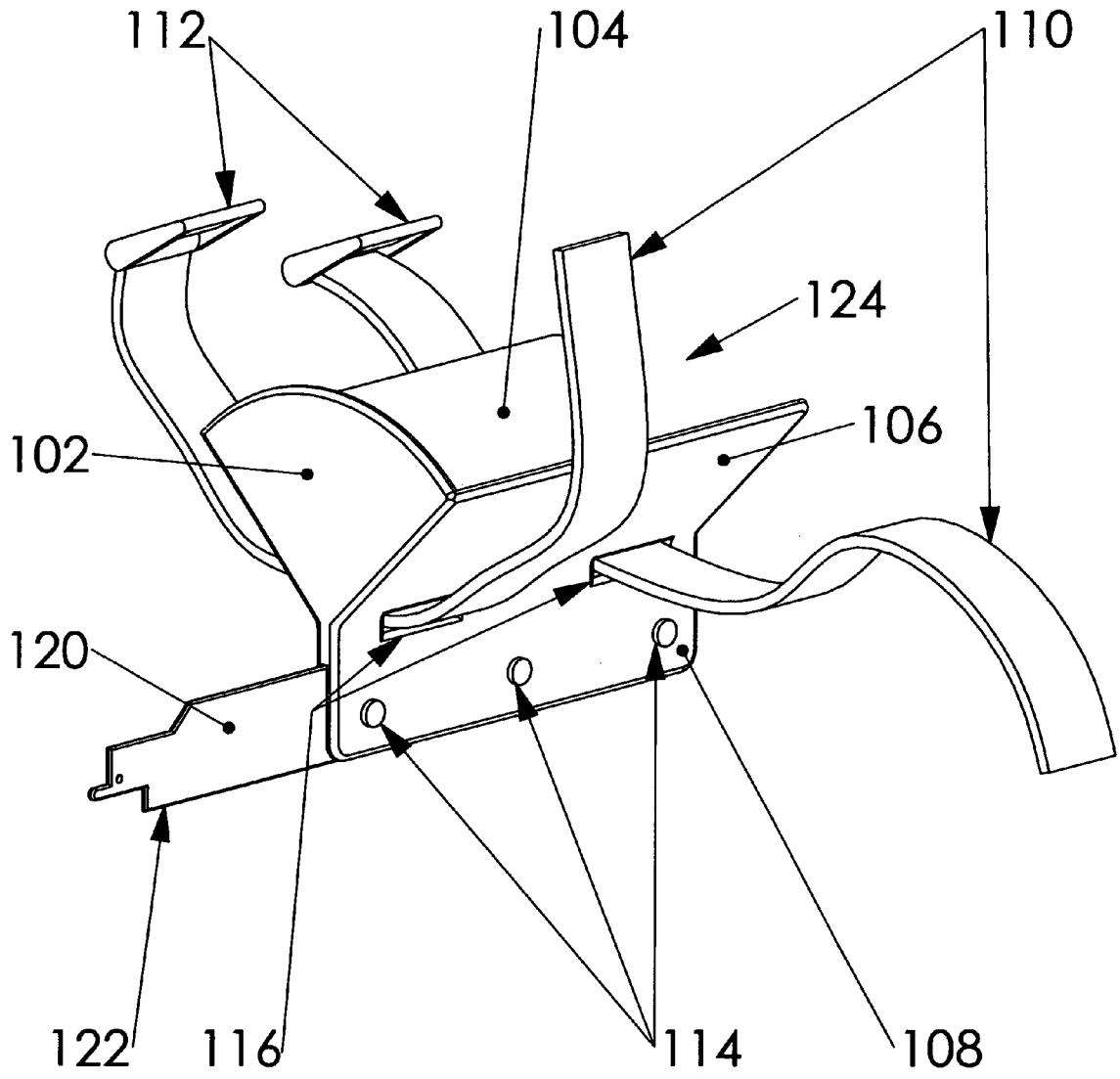
FIG. 1 is a perspective drawing showing a first embodiment of the present invention.

FIG. 1 is a perspective drawing showing a first embodiment of the present invention. With reference to FIG. 1, a paint mixer comprises a cradle 124, a tang 120, and securing straps 110. The proximal end of the tang 122 is sized and shaped so as to removably fit into a chuck of hand-held power tools. The cradle comprises a bottom support surface 102, a first side 104 disposed at an angle to a second side 106, and a bracket 108. The bracket 108 of the cradle 124 is securely fastened to the tang 120 by rivets 114 or other fastening means. The cradle 124 may be removably mounted to the tang 120 so that cradles of different sizes or shapes may be mounted thereupon. In a preferred embodiment, the bracket 108 is a seamless or integrated part of the cradle 124. These sides 104, 106 and bracket 108 may be made of any material. The first side 104 is shown disposed at generally a 90-degree angle to the second side 106. However, these sides 104, 106 may be disposed at any angle and may be of any size, dimension or shape so as to accommodate various sizes of can or other container. In a preferred embodiment, the first side 104 and second side

106 are approximately 5 inches tall and approximately 1.5 inches wide wherein the cradle accommodates a container from about 6 oz to about 32 oz in net weight. The top end of the cradle 124 is open to accommodate cans of various heights. The bottom support surface 102, first side 104, and second side 106 may be made of any size or shape. The bracket 108 and tang 120 each define lengths, wherein the lengths of the bracket and tang are generally collinear or parallel as seen in FIGS. 1 and 2.

Figure 2:
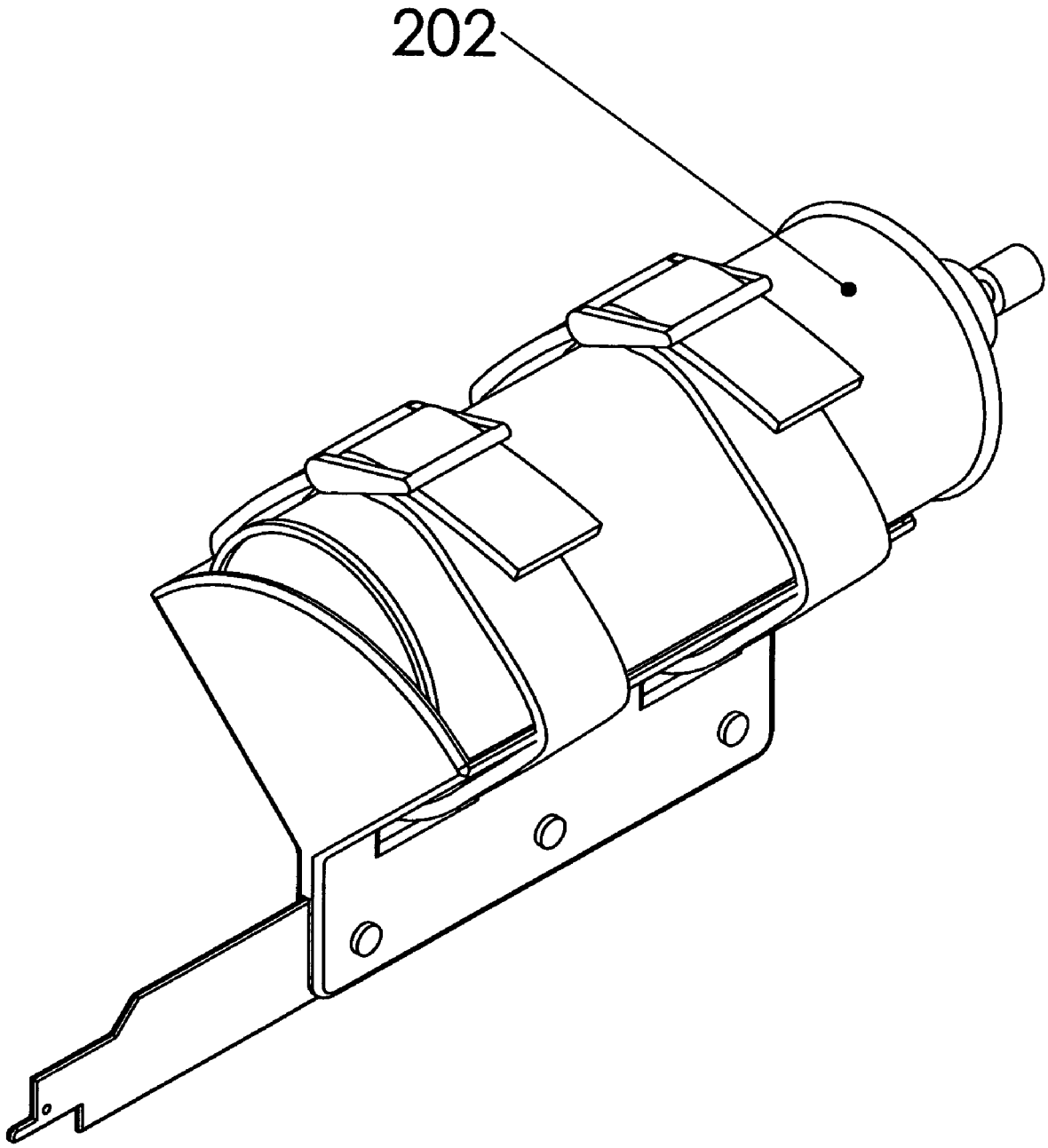
FIG. 2 is a perspective drawing showing the embodiment of FIG. 1 wherein a can of spray paint is securely fastened within the cradle of the apparatus; and, FIG. 3 is a perspective drawing showing a second embodiment of the present invention wherein the cradle additionally comprises magnets.

FIG. 2 is a perspective drawing showing a can of spray paint securely fastened within the apparatus of FIG. 1. With reference to FIG. 2, a can of spray paint 202 is securely fastened into the cradle 124 by placing it flush against the bottom support surface 102, wrapping the loose ends of the securing straps 110 around the cradle 124, through slots 116, and over the open region of the cradle and around the exposed portion of the can 202, and engaging the loose ends into buckles 112. A separate slot 116 is provided to and sized for each securing strap 110 so as to ensure that each securing strap 110 does not move relative to the cradle 124 during operation of the apparatus.

The can 202 is agitated, and correspondingly the contents of the can are mixed, by inserting and securing the proximal end 122 of the tang 120 into the chuck of a power tool and operating the power tool (not shown). In a preferred embodiment, the power tool is a hand-held variable speed reciprocating saw. For example, such reciprocating saw is commercially available tool sold at retail. Other power tools may be used. The power tool should be operated within certain limits such that mixing occurs, no loosening of the securing straps occurs, no movement of the can relative to the cradle occurs, and the can does not open (liquids) or discharge (aerosols). Improved and faster mixing occurs as the power tool is operated at relatively higher revolutions or faster speeds. The power tool should be operated for sufficient time to ensure a desired amount of mixing.

Figure 3:
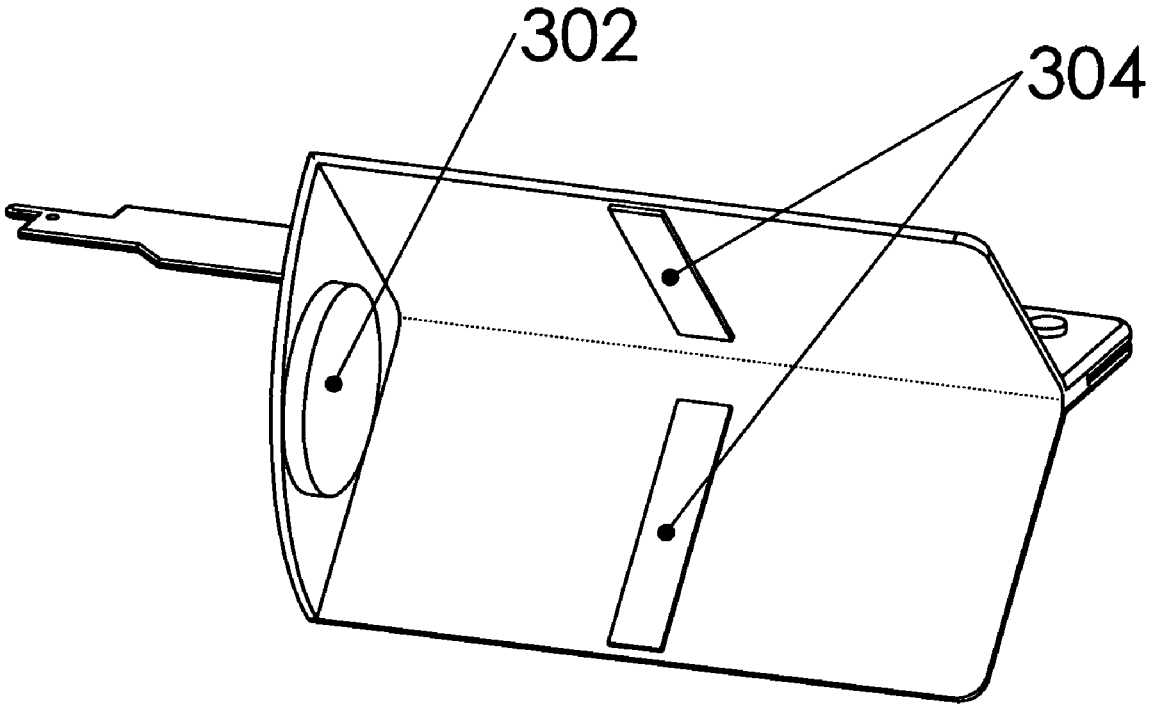

FIG. 3 is a perspective drawing showing a second embodiment of the present invention wherein the cradle additionally comprises magnets. With reference to FIG. 3, a first magnet 302 is placed on the bottom support surface. The first magnet 302 is shown in a circular shape, but any shape or size may be used. Any number of first magnets 302 may also be used on the bottom support surface. A second set of magnets 304 is placed on the sides of the cradle, one magnet per side. Each of the second set of magnets is rectangular in shape. Any shape, size or number of these magnets may be used. The first and second magnets 302, 304 assist in securing a container of material (not shown) in the cradle during agitation of the contents of the container.

While the invention has been particularly shown and described with reference to one or more preferred embodiments, it will be understood by those skilled in the art that various changes in form and detail may be made therein without departing from the spirit and scope of the invention.

I claim:

1. An apparatus for mixing a container of material, said apparatus comprising:

a cradle comprising a first side disposed at an angle to a second side, a bottom support side, and a bracket; wherein one of said first side, second side, and bottom support side comprises a magnet;

at least one securing strap;

a tang having a distal end and a proximal end defining a length therebetween, said distal end having said bracket of said cradle securely affixed thereto, and said proximal end shaped so as to be receivable by a chuck of a hand-held power tool, and wherein the lengths of the tang and bracket are one of generally collinear or parallel.

2. The apparatus of claim 1 wherein said bracket, said first side, and said second side form one continuous part of said cradle.

3. The apparatus of claim 1 wherein said first side comprises a magnet, and said second side comprises a magnet.

4. The apparatus of claim 1 wherein said bottom support side comprises a magnet.

5. A method to mix the contents of a container of material, the method comprising:

mounting a cradle to a working end of a reciprocating hand-held power tool via a tang, wherein the cradle comprises a first side disposed at an angle to a second side, a bottom support side, and a bracket; wherein one of said first side, second side, and bottom support side comprises a magnet;

wherein the cradle and tang each define a length, wherein the lengths of the tang and bracket are one of generally collinear or parallel;

securely mounting said container of material to said cradle; and, operating said reciprocating hand-held power tool to reciprocate said tang and said cradle until said material is mixed to a desired end point.

6. The method of claim 5 wherein said container of material is a can of paint.

7. The method of claim 5 wherein said container of material is up to approximately 32 oz in net weight.

8. The method of claim 5 wherein said container is an aerosol can.

9. The method of claim 5 wherein said first side comprises a magnet, and said second side comprises a magnet.

10. The method of claim 5 wherein said bottom support side comprises a magnet.

* * * * *